US005321981A

United States Patent [19]

Macpherson

[11] Patent Number: 5,321,981

[45] Date of Patent: Jun. 21, 1994

[54] METHODS FOR ANALYSIS OF DRILLSTRING VIBRATION USING TORSIONALLY INDUCED FREQUENCY MODULATION

[75] Inventor: John D. Macpherson, Sugarland, Tex.

[73] Assignee: Baker Hughes Incorporated, Houston, Tex.

[21] Appl. No.: 12,274

[22] Filed: Feb. 1, 1993

[51] Int. Cl.[5] ..... E21B 47/00

[52] U.S. Cl. ..... 73/151; 324/166

[58] Field of Search ..... 73/151, 153, 155; 324/166

[56] References Cited

U.S. PATENT DOCUMENTS

| | | | |
|---|---|---|---|
| 2,958,821 | 11/1960 | Webb | 324/166 |
| 2,985,829 | 5/1961 | Swift | 324/166 |
| 3,345,867 | 10/1967 | Arps | 73/151 |
| 3,588,804 | 6/1971 | Fort | 367/82 |
| 3,697,940 | 10/1972 | Berka | 73/151 |
| 4,001,773 | 1/1977 | Lamel et al. | 367/82 |
| 4,562,559 | 12/1985 | Sharp et al. | 367/82 |
| 4,715,451 | 12/1987 | Bseisu et al. | 73/151 |
| 4,878,206 | 10/1989 | Grosso et al. | 367/83 |
| 4,954,998 | 9/1990 | Rector | 367/82 |
| 5,050,132 | 9/1991 | Duckworth | 367/82 |
| 5,124,953 | 6/1992 | Grosso | 367/82 |
| 5,128,901 | 7/1992 | Drumheller | 367/82 |
| 5,130,951 | 7/1992 | Kingman | 367/82 |
| 5,226,332 | 7/1993 | Wassell | 73/151 |

*Primary Examiner*—Robert J. Warden

*Assistant Examiner*—Hien Tran

*Attorney, Agent, or Firm*—Fishman, Dionne & Cantor

[57] ABSTRACT

Torsional oscillations of the drillstring will lead to frequency modulation (FM) of the signal from a vibratory source (e.g., the bit). This results, in the frequency domain, in sidebands being present around a detected excitation frequency. In accordance with the present invention, it has been discovered that these sidebands may be used in advantageous methods for optimizing drillstring and drilling performance. In a first embodiment of this invention, these sidebands are used to discriminate between downhole and surface vibrational sources. Once the location of the drillstring vibration is determined, appropriate action may be taken to optimize drilling and drillstring performance. In a second embodiment of this invention, the sidebands are used to determine the rotary speed of BHA (bottom hole assembly) components. Using the method of this second embodiment, minimum and maximum rotary speeds of a given BHA component is determined as a function of the excitation frequency, the frequency of torsional oscillation and the modulation index. Once the minimum and maximum rotary speeds of the BHA components are determined, adjustments can be made to alter the rotary speeds and thereby enhance or optimize drilling and drillstring performance. This method is particularly well suited for use in those applications where torsional oscillations are not recognizable in the time domain, but are better recognized in the frequency domain.

9 Claims, 4 Drawing Sheets

METHODS FOR ANALYSIS OF DRILLSTRING VIBRATION USING TORSIONALLY INDUCED FREQUENCY MODULATION

BACKGROUND OF THE INVENTION

This invention relates generally to methods and techniques for the analysis of vibration data in oil and gas well drilling. More particularly, this invention relates to the use of frequency modulation sidebands observed from detected frequency domain vibration data for (1) discriminating between surface and downhole vibratory sources and (2) the determination of the rotary speed of bottom-hole-assembly (BHA) components.

During drilling, various sources excite the drillstring. The amplitude of the resultant drillstring vibrations will depend on the level (severity) of the excitation, the system damping and the proximity of the excitation frequency to a natural frequency of the drillstring. When the frequency of any of the excitation sources is a natural frequency of the drillstring (axial, torsional or lateral) then the string resonates. Vibration levels are generally highest at resonance, but high level vibrations may exist in the drillstring, independent of drillstring resonance, whenever a high level of excitation is present.

Torsional vibration often manifests itself as a stick/-slip action of the bottomhole assembly (BHA). Indicators of these downhole vibrations can be monitored at or near the surface. This stick/slip phenomenon is described in a paper entitled "A Study of Slip-Stick Motion of the Bit" by A. Kyllingstad and G. W. Halsey, Society of Petroleum Engineers (SPE) Paper 16659, Sep. 1987. As discussed in that paper, torsional oscillations are caused by alternating slipping and sticking of the bottom hole assembly (BHA) as it rotates in the borehole. This phenomenon is associated with a large amplitude, sinusoidial and often saw-tooth like variation in the applied torque. The term slip-stick motion refers to the belief that the amplitude of the torsional oscillations becomes so large that the drillcollar section periodically comes to a complete stop and does not come free until enough torque is built up in the drillstring to overcome the static friction.

Drilling with large amplitude vibrations will result in accelerated drillstring fatigue. A recent study of drillstring failures indicated that fatigue was the primary cause of the examined failures (see Hill, T. H.; Seshadri, P. V.; Durham, K. S., "A Unified Approach to Drillstring Failure Prevention," SPE/IAOC 22002, Mar. 1991, Amsterdam). Most current efforts aimed at understanding and controlling drillstring vibrations focus on the failure of drillstring components. However, during drilling, the drillstring transfers power from the surface to the bit and high amplitude drillstring vibrations may represent a loss, or waste, of drilling energy. Therefore, high levels of vibration not only result in drillstring component failures but can also result in sub-optimum drill rates.

The avoidance of high vibration levels can be attempted in two ways: (a) the BHA can be modeled and a harmonic analysis performed to predict the operating conditions, weight-on-bit (WOB) and rotary speed (RPM), which avoid resonant conditions or (b) the vibrations can be directly monitored while drilling to determine the optimum operating conditions (WOB, RPM and pump rate).

The use of modelling analysis is limited by the number of unknowns that occur in real-time drilling operation. In addition, most models focus on drillstring resonance frequencies, and estimate bit rotary speeds which will avoid exicting these frequencies ("critical speed" analysis). Therefore, they do not take into account high level excitations independent of this resonance analysis.

There is a continuing need for improved methods of using drillstring vibration data to enhance or optimize drilling performance and/or drillstring performance. For example, there is a need for a method to locate the source (e.g., surface or downhole source) of drillstring vibration so that corrective action may be taken to prevent drillstring fatigue and less than optimum drilling rates. In addition, there is a continuing need for methods of using drillstring vibration data to determine the rotary speed of BHA components to enhance or optimize the life of the BHA components and the drilling performance.

SUMMARY OF THE INVENTION

The above-discussed and other problems and deficiencies of the prior art are overcome or alleviated by the methods for using vibration data for the optimization or enhancement of drilling and/or drillstring Performance of the present invention. Torsional oscillations of the drillstring will lead to frequency modulation (FM) of the signal from a vibratory source (e.g., the bit). This results, in the frequency domain, in sidebands being present around a detected excitation frequency. In accordance with the present invention, it has been discovered that these sidebands may be used in advantageous methods for optimizing drillstring and drilling performance.

In a first embodiment of this invention, these sidebands are used to discriminate between downhole and surface vibrational sources caused by torsionally induced frequency modulation. The number of sidebands depends on the ratio of the max angular frequency due to the oscillatory motion and the frequency of these oscillations (termed the modulation index). Since the oscillation frequency is a constant for a given drillstring length, drillstring configuration and wellbore, the number of sidebands is directly proportional to the maximum angular frequency. There is a maximum of these sidebands at the bit (the 'working end') of the pendulum, and a minimum (or zero) of these sidebands at the surface. Therefore, surface vibratory sources will be distinguishable by the absence of sidebands (zero modulation index). Downhole vibratory sources will have sidebands, the number of sidebands (and the modulation index) increasing from the surface to the distal end of the pendulum.

Once the location of the drillstring vibration is determined, appropriate action such as changing drilling parameters, for example, weight-on-bit (WOB) or mud properties may be taken to optimize drilling and drillstring performance.

In a second embodiment of this invention, the sidebands are used to determine the rotary speed of BHA components. Using the method of this second embodiment, minimum and maximum rotary speeds of a given BHA component is determined as a function of the excitation frequency, the frequency of torsional oscillation and the modulation index. Once the minimum and maximum rotary speeds of the BHA components are determined, adjustments can be made to alter the rotary speed of the drillstring and thereby enhance or optimize drilling and drillstring performance. This method is particularly well suited for use in those applications where torsional oscillations are not recognizable in the time domain, but are better recognized in the frequency domain.

The above-described and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
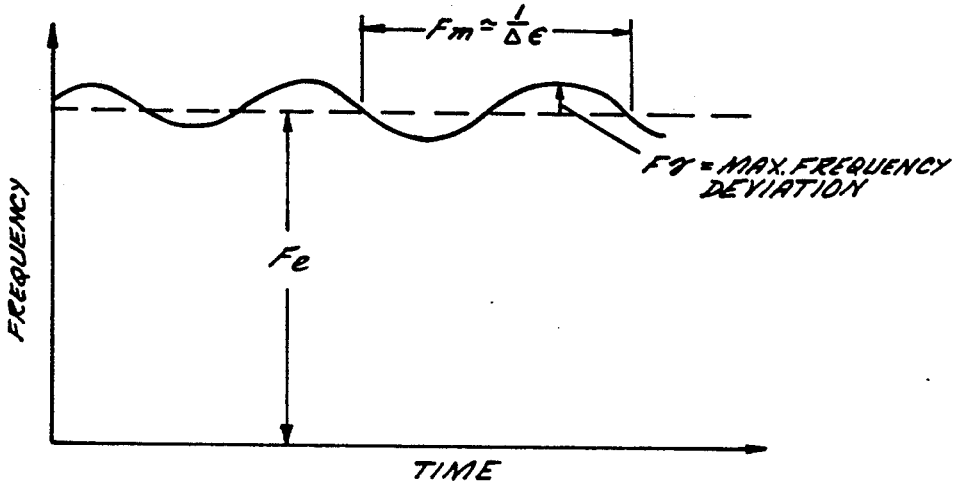
FIG. 1 is a graphical depiction for a drillstring, showing frequency modulation of the signal from a vibration source.

While drilling wells it is possible for the drillstring to act as a torsional pendulum (also referred to as 'stick-slip' motion). This will result in frequency modulation (FM) of any excitation source (e.g., the bit), the degree of modulation being dependent upon the location of the source in the string. FIG. 1 is a graphical depiction showing frequency modulation of the torsional signal from a vibratory source in a drillstring. Sources at the bit will experience a high degree of modulation; sources at the surface should not experience modulation.

Figure 2:
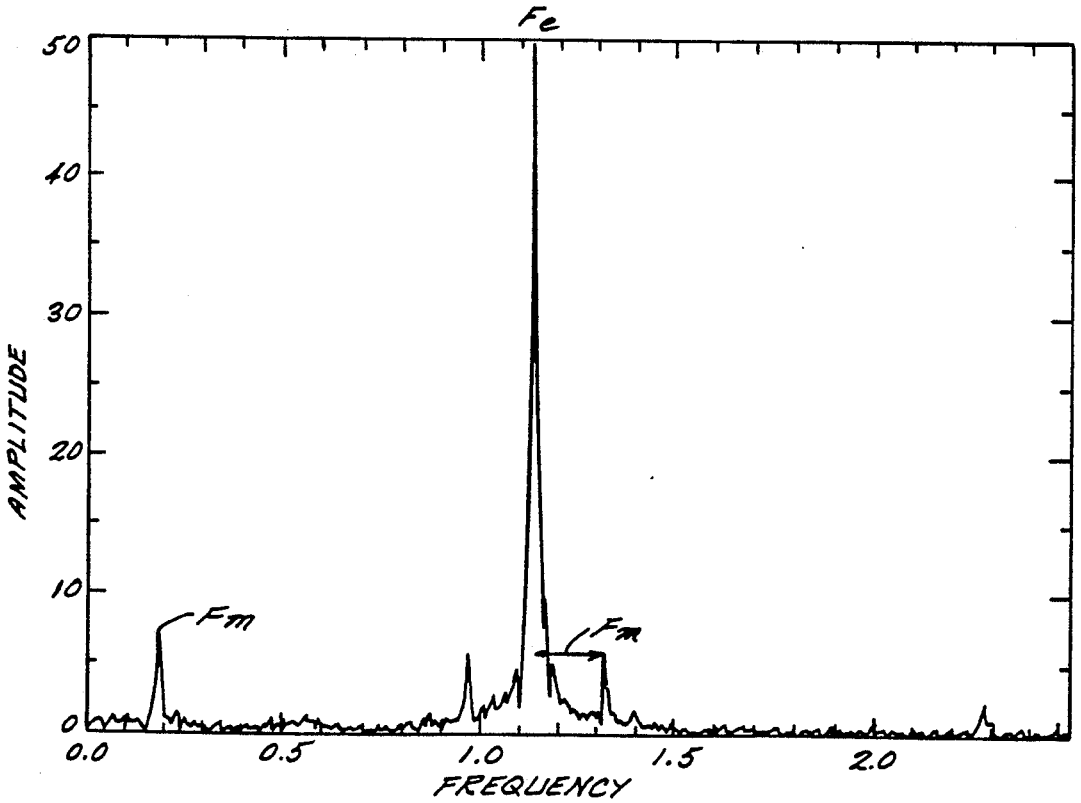
FIG. 2 is a graphical depiction for a drillstring showing, in the frequency domain, sidebands being present around the detected excitation frequency.

Frequency Modulation is apparent in the time domain as a series of periodic 'beats'. However, beats can also be generated by closely spaced excitation sources or by amplitude modulation. Thus, under certain circumstances, such periodic 'beats' in the time domain caused by torsional oscillations (e.g., stick-slip phenomenon) do not provide a recognizable signature in the time domain. In contrast, in the frequency domain, FM is readily distinguishable since it will generate several sidebands around the modulated frequency. FIG. 2 is a graphical depiction showing, in the frequency domain, sidebands being present around the detected excitation frequency. The spacing between the sidebands is governed by the modulating frequency (the frequency of oscillation of the torsional series of periodic pendulum—the periodicity of the 'stick-slip' motion). The number of sidebands depends on the ratio of the max angular frequency due to the oscillatory motion and the frequency of these oscillations (termed the modulation index). Since the oscillation frequency is a constant for a given drillstring length, drillstring configuration and wellbore, the number of sidebands is directly proportional to the maximum angular frequency. This is a maximum at the bit (the 'working end') of the pendulum, and a minimum (or zero) at the surface.

Therefore, in accordance with a first embodiment of this invention, surface vibratory sources are distinguishable by the absence of sidebands (zero modulation index). In contrast, downhole vibratory sources will have sidebands, the number of sidebands (and the modulation index) increasing from the surface to the distal end of the pendulum. Thus, referring to FIG. 3, a plot of amplitude vs frequency is depicted for a drillstring. The data is from a vertical onshore well at a depth of approximately 10,900 ft (3370 m), drilling with a roller-cone bit and mud motor surface rotary speed of 68, WOB of 26,000 lbs (116 kN), pump rate of 105 with triplex pumps. As indicated on FIG. 3, downhole vibration sources show sidebands downhole with such sidebands decreasing along the drillstring towards the surface where there are no apparent sidebands.

Once the source of the vibration is determined (e.g., discriminated as originating from downhole or at the surface) using the method of the first embodiment of this invention, corrective action may be taken to optimize drilling performance and preclude drillstring fatigue. Such corrective action may include changing drilling parameters, for example, weight-on-bit (WOB) or mud properties.

Figure 3:
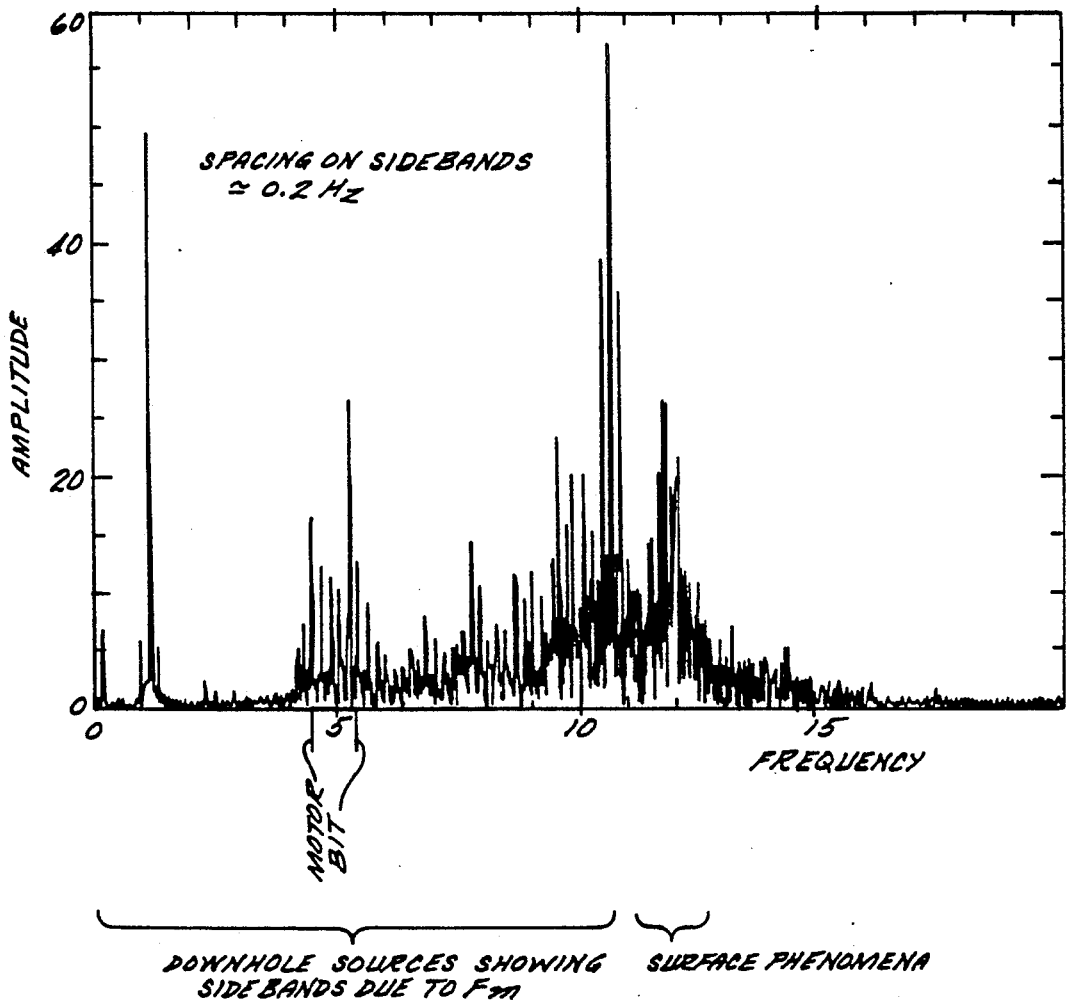
FIG. 3 is a plot of amplitude vs frequency for a drillstring for discriminating between downhole and surface vibrations.
Figure 4:
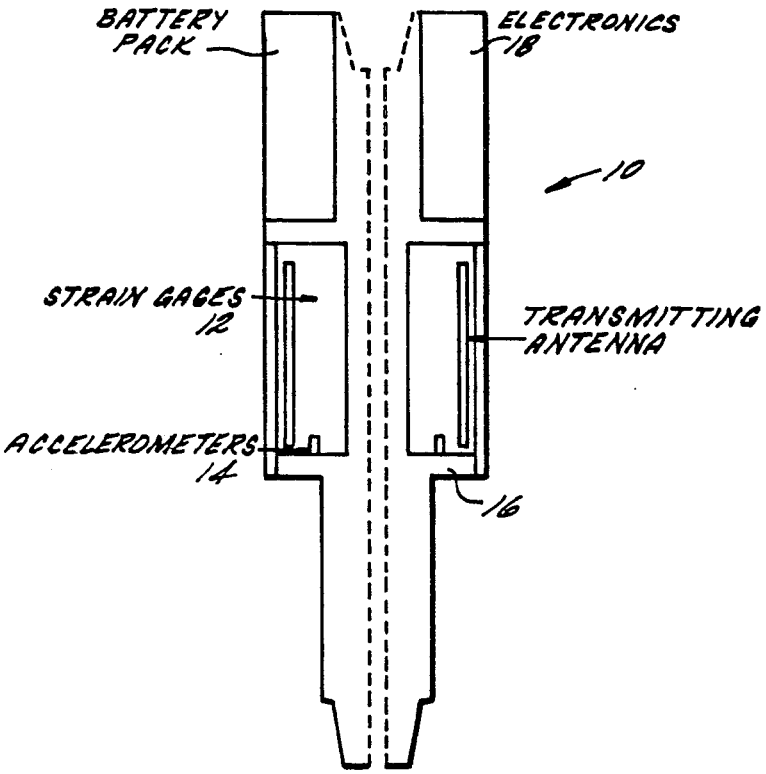
FIG. 4 is a cross-sectional schematic side elevation view of a drillstring vibration measurement sub.

Measurement of drillstring vibrations in order to obtain the data for the graphs of FIG. 3 may be obtained from any number of known vibration measurement systems (located downhole or at the surface). Preferably, the drillstring vibration data is collected from a surface measurement system of the type described in Besaisow, A. A., Jan, Y. M., Schuh, F. J., "Detection of Various Drilling Phenomena Utilizing High Frequency Surface Measurements", 1985, SPE 14327 Las Vegas and U.S. Pat. No. 4,715,451, all of the contents of which are incorporated herein by reference. A commercial version of this vibration measurement system is known as the ADAMS Mark 3 sub which is used in vibration monitoring services offered by EXLOG, INC. under the servicemark DynaByte. Referring to FIG. 4, this sub is shown at 10 and contains a suite of sensors, consisting of strain gauges 12 and accelerometers 14, mounted on a 4145H modified steel sub 16. The sub 16 fits into the drillstring below the kelly swivel.

Full bridge semiconductor strain gauges 12 are used to measure dynamic axial force and dynamic torsional moment; foil type gauges are used to measure string weight and torque. Paired accelerometers 14 are used to measure axial and torsional acceleration. Several ancillary sensors are also used; these include a magnetometer for surface rotary speed, a pressure transducer for pump pressure and operational sensors such as battery voltage and temperature.

A specialized data acquisition system 18 contained within the sub 16 housing digitizes and encodes data from the sensors. Sample rates are programmable and typically 2083 samples per second per channel is used. Anti-aliasing filters are used prior to sampling to ensure a non-aliased measurement with a 500 Hz bandwidth. The measured data is transferred to an on-site unit, at a rate of 250 kbits/sec, utilizing a microwave transmitter and omnidirectional antenna mounted within the sub housing. In addition to efficiently transferring data from a rotating medium, microwave telemetry also alleviates the need to run data and power lines to the rig floor. Power to the system is provided by a removable and rechangeable battery pack.

In accordance with a second embodiment of the present invention, the sidebands of FIG. 2 are used to determine the rotary speeds of a BHA component. The spacing between sidebands depends upon the periodicity of the torsional oscillations. In accordance with this second embodiment, it has been determined that the minimum and maximum rotary speeds of the BHA component can be found from the following:

$$RPM\ min = 60\ [Fe - \alpha Fm] \quad 1(a)$$

$$RPM\ max = 60\ [Fe + \alpha Fm] \quad 1(b)$$

where,

Fe = the excitation frequency

Fm = the frequency of torsional oscillation $\alpha$ = the modulation index

The excitation frequency Fe is the center peak in the 'bundle'.

The frequency of torsional oscillations Fm is given by the frequency spacing of the sidebands.

The modulation index $\alpha$ can be found as follows:

The amplitude of each peak in the 'bundle' is given by the following:

| | |
|---|---|
| Main Peak (excitation): | $A_0 \times J_0(\alpha)$ |
| 1st sideband: | $A_0 \times J_1(\alpha)$ |
| 2nd sideband: | $A_0 \times J_2(\alpha)$ |
| . . . | |
| Nth sideband: | $A_0 \times J_N(\alpha)$ |

where, $A_0$ is the original (unmodulated) amplitude of the excitation;

$\alpha$ is the modulation index; and $J_0 \ldots J_n$ are Bessel functions of the first kind evaluated at $\alpha$.

It will be appreciated from the above that the amplitude ratios of adjacent peaks are given by the ratios of the Bessel functions evaluated at the modulation index. There is, therefore, a direct correspondence between the ratios of the Bessel functions and the peak amplitude ratios. For example, Table 1 shows the amplitude ratio of the first sideband to the center peak versus the modulation index (the table is only one-to-one for values of the modulation index less than approximately 2.4). If the amplitude ratio of the peaks is calculated, then the modulation index can be easily read from the table. Of course, it will be appreciated that the table method may be replaced by computerized software using a more enhanced scheme taking into account ratios of other sidebands.

The method of the second embodiment of this invention may be summarized as follows:

(1) Divide the amplitude of the first sideband by the amplitude of the center peak.

(2) Use the provided table to find the modulation index (or a software program).

(3) Use Equation la and lb to find the minimum rotary speed of the drillstring component.

TABLE 1

| AMP RATIO | MOD INDEX |
|---|---|
| 0.005 | 0.010 |
| 0.010 | 0.020 |
| 0.015 | 0.030 |
| 0.020 | 0.040 |
| 0.025 | 0.050 |
| 0.030 | 0.060 |
| 0.035 | 0.070 |
| 0.040 | 0.080 |
| 0.045 | 0.090 |
| 0.050 | 0.100 |
| 0.055 | 0.110 |

TABLE 1-continued

| AMP RATIO | MOD INDEX |
|---|---|
| 0.060 | 0.120 |
| 0.065 | 0.130 |
| 0.070 | 0.140 |
| 0.075 | 0.150 |
| 0.080 | 0.160 |
| 0.085 | 0.170 |
| 0.090 | 0.180 |
| 0.095 | 0.190 |
| 0.101 | 0.200 |
| 0.106 | 0.210 |
| 0.111 | 0.220 |
| 0.116 | 0.230 |
| 0.121 | 0.240 |
| 0.126 | 0.250 |
| 0.131 | 0.260 |
| 0.136 | 0.270 |
| 0.141 | 0.280 |
| 0.147 | 0.290 |
| 0.152 | 0.300 |
| 0.157 | 0.310 |
| 0.162 | 0.320 |
| 0.167 | 0.330 |
| 0.173 | 0.340 |
| 0.178 | 0.350 |
| 0.183 | 0.360 |
| 0.188 | 0.370 |
| 0.194 | 0.380 |
| 0.199 | 0.390 |
| 0.204 | 0.400 |
| 0.209 | 0.410 |
| 0.215 | 0.420 |
| 0.220 | 0.430 |
| 0.226 | 0.440 |
| 0.231 | 0.450 |
| 0.236 | 0.460 |
| 0.242 | 0.470 |
| 0.247 | 0.480 |
| 0.253 | 0.490 |
| 0.258 | 0.500 |
| 0.264 | 0.510 |
| 0.269 | 0.520 |
| 0.275 | 0.530 |
| 0.280 | 0.540 |
| 0.286 | 0.550 |
| 0.292 | 0.560 |
| 0.297 | 0.570 |
| 0.303 | 0.580 |
| 0.309 | 0.590 |
| 0.314 | 0.600 |
| 0.320 | 0.610 |
| 0.326 | 0.620 |
| 0.332 | 0.630 |
| 0.338 | 0.640 |
| 0.343 | 0.650 |
| 0.349 | 0.660 |
| 0.355 | 0.670 |
| 0.361 | 0.680 |
| 0.367 | 0.690 |
| 0.373 | 0.700 |
| 0.379 | 0.710 |
| 0.386 | 0.720 |
| 0.392 | 0.730 |
| 0.398 | 0.740 |
| 0.404 | 0.750 |
| 0.410 | 0.760 |
| 0.417 | 0.770 |
| 0.423 | 0.780 |
| 0.429 | 0.790 |
| 0.436 | 0.800 |
| 0.442 | 0.810 |
| 0.449 | 0.820 |
| 0.455 | 0.830 |
| 0.462 | 0.840 |
| 0.469 | 0.850 |
| 0.475 | 0.860 |
| 0.482 | 0.870 |
| 0.489 | 0.880 |
| 0.496 | 0.890 |
| 0.503 | 0.900 |
| 0.510 | 0.910 |

TABLE 1-continued

| AMP RATIO | MOD INDEX |
|---|---|
| 0.517 | 0.920 |
| 0.524 | 0.930 |
| 0.531 | 0.940 |
| 0.538 | 0.950 |
| 0.545 | 0.960 |
| 0.553 | 0.970 |
| 0.560 | 0.980 |
| 0.568 | 0.990 |
| 0.575 | 1.000 |
| 0.583 | 1.010 |
| 0.590 | 1.020 |
| 0.598 | 1.030 |
| 0.606 | 1.040 |
| 0.614 | 1.050 |
| 0.622 | 1.060 |
| 0.630 | 1.070 |
| 0.638 | 1.080 |
| 0.646 | 1.090 |
| 0.654 | 1.100 |
| 0.633 | 1.110 |
| 0.671 | 1.120 |
| 0.680 | 1.130 |
| 0.688 | 1.140 |
| 0.697 | 1.150 |
| 0.706 | 1.160 |
| 0.715 | 1.170 |
| 0.724 | 1.180 |
| 0.733 | 1.190 |
| 0.742 | 1.200 |
| 0.752 | 1.210 |
| 0.761 | 1.220 |
| 0.771 | 1.230 |
| 0.781 | 1.240 |
| 0.791 | 1.250 |
| 0.801 | 1.260 |
| 0.811 | 1.270 |
| 0.821 | 1.280 |
| 0.831 | 1.290 |
| 0.842 | 1.300 |
| 0.853 | 1.310 |
| 0.863 | 1.320 |
| 0.874 | 1.330 |
| 0.886 | 1.340 |
| 0.897 | 1.350 |
| 0.908 | 1.360 |
| 0.920 | 1.370 |
| 0.932 | 1.380 |
| 0.944 | 1.390 |
| 0.956 | 1.400 |
| 0.968 | 1.410 |
| 0.981 | 1.420 |
| 0.994 | 1.430 |
| 1.007 | 1.440 |
| 1.020 | 1.450 |
| 1.034 | 1.460 |
| 1.047 | 1.470 |
| 1.061 | 1.480 |
| 1.076 | 1.490 |
| 1.090 | 1.500 |
| 1.105 | 1.510 |
| 1.120 | 1.520 |
| 1.135 | 1.530 |
| 1.151 | 1.540 |
| 1.167 | 1.550 |
| 1.183 | 1.560 |
| 1.200 | 1.570 |
| 1.216 | 1.580 |
| 1.234 | 1.590 |
| 1.251 | 1.600 |
| 1.269 | 1.610 |
| 1.288 | 1.620 |
| 1.307 | 1.630 |
| 1.326 | 1.640 |
| 1.346 | 1.650 |
| 1.366 | 1.660 |
| 1.387 | 1.670 |
| 1.408 | 1.680 |
| 1.429 | 1.690 |
| 1.452 | 1.700 |
| 1.475 | 1.710 |

TABLE 1-continued

| AMP RATIO | MOD INDEX |
|---|---|
| 1.498 | 1.720 |
| 1.522 | 1.730 |
| 1.547 | 1.740 |
| 1.572 | 1.750 |
| 1.598 | 1.760 |
| 1.625 | 1.770 |
| 1.653 | 1.780 |
| 1.681 | 1.790 |
| 1.710 | 1.800 |
| 1.741 | 1.810 |
| 1.772 | 1.820 |
| 1.804 | 1.830 |
| 1.837 | 1.840 |
| 1.872 | 1.850 |
| 1.907 | 1.860 |
| 1.944 | 1.870 |
| 1.982 | 1.880 |
| 2.021 | 1.890 |
| 2.062 | 1.900 |
| 2.105 | 1.910 |
| 2.149 | 1.920 |
| 2.195 | 1.930 |
| 2.242 | 1.940 |
| 2.292 | 1.950 |
| 2.344 | 1.960 |
| 2.398 | 1.970 |
| 2.455 | 1.980 |
| 2.514 | 1.990 |
| 2.576 | 2.000 |
| 2.641 | 2.010 |
| 2.709 | 2.020 |
| 2.781 | 2.030 |
| 2.857 | 2.040 |
| 2.936 | 2.050 |
| 3.021 | 2.060 |
| 3.110 | 2.070 |
| 3.204 | 2.080 |
| 3.304 | 2.090 |
| 3.411 | 2.100 |
| 3.525 | 2.110 |
| 3.646 | 2.120 |
| 3.777 | 2.130 |
| 3.916 | 2.140 |
| 4.067 | 2.150 |
| 4.230 | 2.160 |
| 4.406 | 2.170 |
| 4.598 | 2.180 |
| 4.808 | 2.190 |
| 5.038 | 2.200 |
| 5.291 | 2.210 |
| 5.571 | 2.220 |
| 5.883 | 2.230 |
| 6.233 | 2.240 |
| 6.627 | 2.250 |
| 7.075 | 2.260 |
| 7.590 | 2.270 |
| 8.187 | 2.280 |
| 8.887 | 2.290 |
| 9.720 | 2.300 |
| 10.729 | 2.310 |
| 11.975 | 2.320 |
| 13.553 | 2.330 |
| 15.617 | 2.340 |
| 18.433 | 2.350 |
| 22.505 | 2.360 |
| 28.913 | 2.370 |
| 40.483 | 2.380 |
| 67.655 | 2.390 |
| 207.437 | 2.400 |

Figure 5:
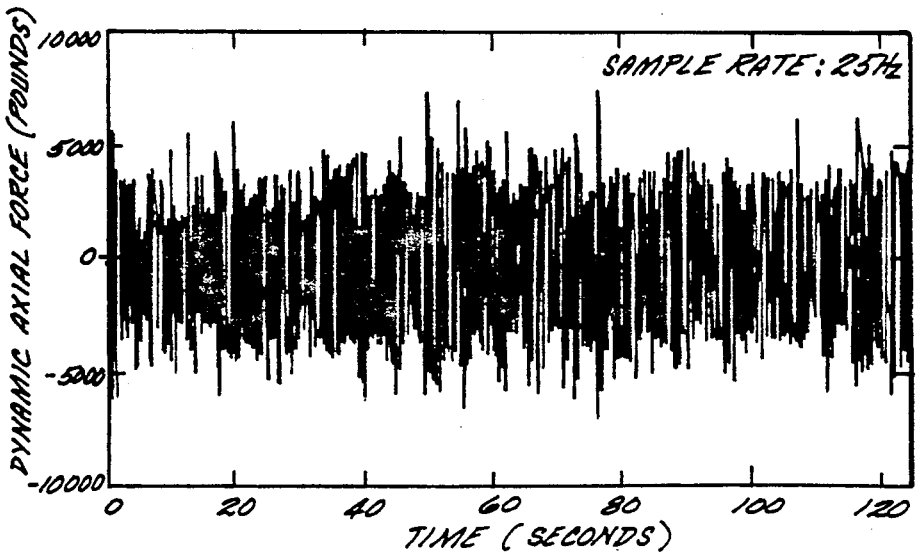
FIG. 5 is a graph depicting frequency vs amplitude for data set at 25 Hz.
Figure 6:
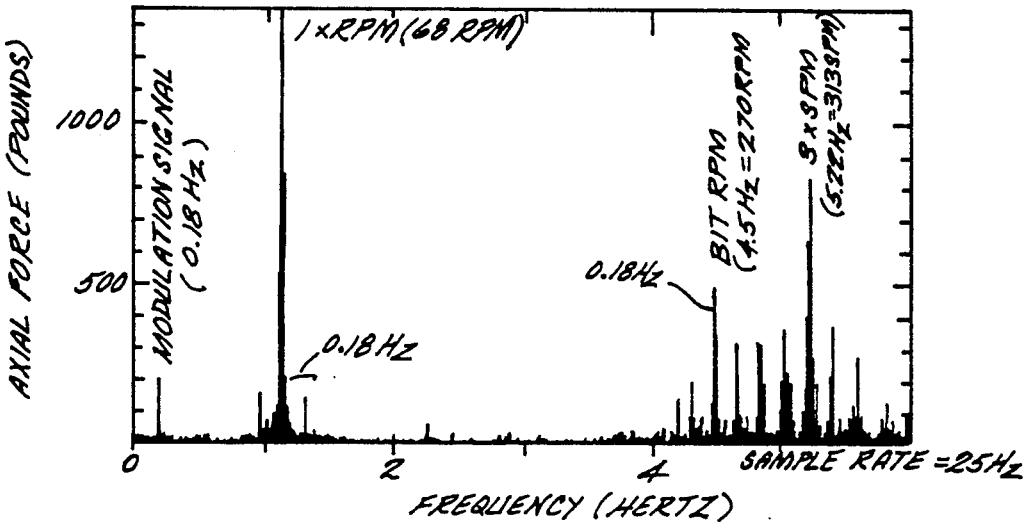
FIG. 6 is a graph depicting amplitude vs frequency for the time domain data set of FIG. 5.

As discussed, torsional oscillation produces a frequency modulated signal; this modulation ranges from zero (if the bit comes to a complete stop) to the maximum bit speed as the bit "unwinds". Axial vibration levels will vary with the bit speed. Therefore, when the bit is rotating at lower speeds the axial vibration level is lower, and conversely when the bit rotates at higher speeds the vibration levels are higher. This produces visible amplitude modulation (or 'beats') of the axial signals detected at the surface; it may also produce frequency modulation of the monitored axial signals. In the example of FIG. 5, however, the characteristic 'beats' are not apparent. The data is from a vertical onshore well at a depth of approximately 10,900 ft (3370 m), drilling with a rollercone bit and mud motor surface rotary speed of 68, WOB of 26,000 lbs (116 kN), pump rate of 105 with triplex pumps. Significantly, in the amplitude spectra of this data set, shown in FIG. 6, the frequency modulation of the bit RPM signal is easily identified by the presence of multiple sidebands. These sidebands have a frequency spacing equal to the modulating frequency of 0.18 Hz (period of 5.56 seconds). The surface rotary signal is also modulated; however, the degree of modulation is less than that imposed on the bit RPM signal.

Once frequency modulation is established, the minimum and maximum rotary speeds may be estimated using Equations 1(*a*) and 1(*b*) as described above. For the example shown, the RPM range experienced by the bit is 261-279 RPM. It will be appreciated such a small oscillation is difficult to detect on static torsional channels.

Bit

Fe=4.50 Hz
Fm=0.18 Hz
Amplitude Ratio=4.3
Modulation Index=0.85
RPM min=60 [4.5−0.8 (0.18)]=261 RPM
RPM max=60 [4.5+0.8 (0.18)]=279 RPM
RPM ave=270 RPM Once the rotary speed of the BHA components is determined using the method of the second embodiment of this invention, the drilling operation can be optimized or improved by, for example, altering the rotary speed of the drillstring.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for analyzing drillstring vibration and optimizing at least one of drillstring performance and drilling performance comprising the steps of:

(a) detecting vibratory signals in a drillstring;

(b) converting said detected vibratory signals to frequency domain wherein sidebands are exhibited around at least one detected excitation frequency due to frequency modulation;

(c) using said sidebands to analyze drillstring vibration; and (d) optimizing at least one of drillstring performance and drilling performance based on the analysis of step (c).

2. The method of claim 1 wherein step (c) further comprises the step of:

discriminating between downhole drillstring vibrational sources and surface drillstring vibrational sources using torsionally induced frequency modulation wherein the number of sidebands decrease from a downhole location towards the surface.

3. The method of claim 2 wherein said step of discriminating comprises:

detecting an absence of sidebands indicating surface drillstring vibrations; and detecting sidebands which increase from the surface toward a distal end of the drillstring indicating downhole drillstring vibrations.

4. The method of claim 1 wherein step (c) further comprises the step of: using said sidebands to determine frequency of torsional oscillation and modulation index;

determining rotary speed of at least one bottom hole assembly (BHA) component as a function of the excitation frequency, the frequency of torsional oscillation and the modulation index.

5. The method of claim 4 wherein step (c) further comprises determining the minimum rotary speed of BHA component (RPM min) and the maximum rotary speed of a BHA component (RPM max) as follows:

$$RPM\ min = 60\ Fe - \alpha Fm]$$

$$RPM\ max = 60\ Fe + \alpha Fm]$$

where,

Fe=the excitation frequency

Fm=the frequency of torsional oscillation $\alpha$=the modulation index.

6. A method of discriminating between downhole drillstring vibrational sources and surface drillstring vibrational sources and optimizing at least one of drillstring performance and drilling performance comprising the steps of:

(a) detecting vibratory signals in a drillstring;

(b) converting said detected vibratory signals to frequency domain wherein sidebands are exhibited around at least one detected excitation frequency due to frequency modulation;

(c) using said sidebands to discriminate between downhole drillstring vibrational sources and surface drillstring vibrational sources using torsionally induced frequency modulation wherein the number of sidebands decreases from a downhole location towards the surface; and (d) optimizing at least one of drillstring performance and drilling performance based on the discrimination of step (c).

7. The method of claim 6 wherein step (c) comprises:

detecting an absence of sidebands indicating surface drillstring vibrations; and detecting sidebands which increase from the surface toward a distal end of the drillstring indicating downhole drillstring vibrations.

8. A method for determining the rotary speed of at least one bottom hole assembly (BHA) component and optimizing at least one of drillstring performance and drilling performance comprising the steps of:

(a) detecting vibratory signals in a drillstring;

(b) converting said vibratory signals to frequency domain wherein sidebands are exhibited around at least one detected excitation frequency due to frequency modulation; (c) using said sidebands to determine frequency of torsional oscillation and modulation index;

(d) determining rotary speed of at least one bottom hold assembly (BHA) component as a function of the excitation frequency, the frequency of torsional oscillation and the modulation index; and (e) optimizing at least one of drillstring performance and drilling performance based on the determination of rotary speed of step (c).

9. The method of claim 8 wherein step (d) further comprises determining the minimum rotary speed of BHA component (RPM min) and the maximum rotary speed of a BHA component (RPM max) as follows:

$$RPM\ min = 60\ [Fe - \alpha Fm]$$

$$RPM\ max = 60\ [Fe + \alpha Fm]$$

where,

Fe = the excitation frequency

Fm = the frequency of torsional oscillation $\alpha$ = the modulation index.

* * * * *